United States Patent [19]

Watanabe et al.

[11] 4,004,513

[45] Jan. 25, 1977

[54] METHOD AND APPARATUS FOR PREVENTING INK SMEARS IN AN ELECTROSTATIC INK MIST PRINTING SYSTEM

[75] Inventors: Akinori Watanabe; Takao Ando, both of Takasaki, Japan

[73] Assignee: Electroprint, Inc., Cupertino, Calif.

[22] Filed: Nov. 13, 1975

[21] Appl. No.: 631,548

Related U.S. Application Data

[63] Continuation of Ser. No. 435,562, Jan. 22, 1974, abandoned.

[52] U.S. Cl. ..... 101/426; 101/DIG. 13; 118/644; 427/21; 101/129

[51] Int. Cl.[2] ..... B41C 1/14

[58] Field of Search ..... 101/426, DIG. 13, 114, 101/129; 118/637; 355/10, 15, 17; 346/75; 427/21, 30

[56] References Cited

UNITED STATES PATENTS

| | | | |
|---|---|---|---|
| 2,842,456 | 7/1958 | Carlson | 427/21 |
| 2,862,472 | 12/1958 | Carlson | 427/21 X |
| 2,911,944 | 11/1959 | Hayford et al. | 427/21 X |
| 3,434,865 | 3/1969 | Doquire et al. | 101/114 X |
| 3,592,541 | 7/1971 | Gourdine | 355/17 |
| 3,779,166 | 12/1973 | Pressman et al. | 101/426 |

*Primary Examiner*—E. H. Eickholt
*Attorney, Agent, or Firm*—Townsend and Townsend

[57] ABSTRACT

A high speed printing apparatus for causing ions generated by the application of a high voltage to adhere to ink particles and causing the ink particles to be absorbed selectively to recording paper for printing, wherein a layer of air flow is produced selectively between the recording paper and the ink mist in response to the completion of printing operation or the stoppage of feed of the recording paper.

5 Claims, 1 Drawing Figure

Figure 1:
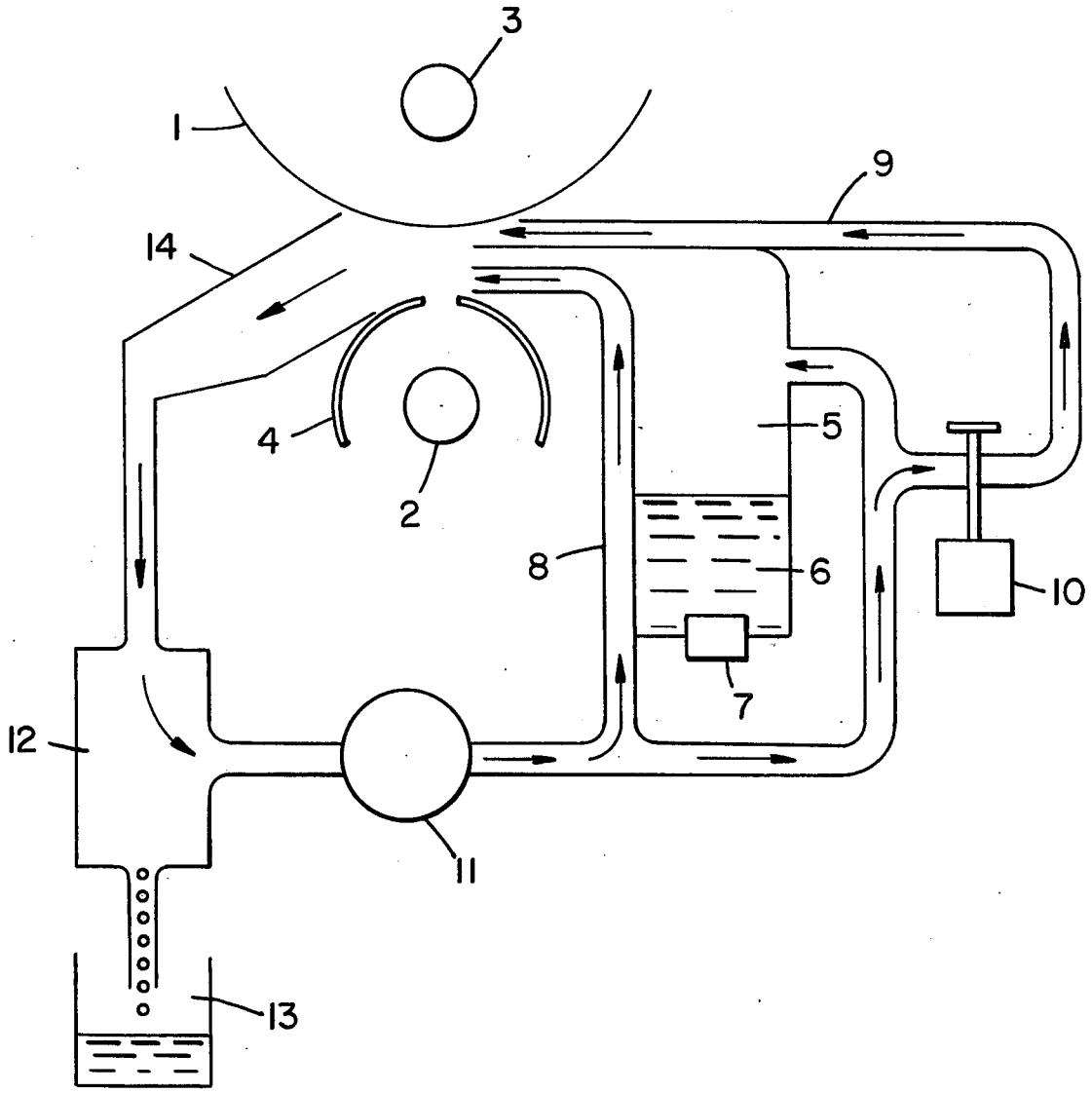

METHOD AND APPARATUS FOR PREVENTING INK SMEARS IN AN ELECTROSTATIC INK MIST PRINTING SYSTEM

This is a continuation of application Ser. No. 435,562 filed Jan. 22, 1974 and now abandoned.

The present invention relates to a high speed printing apparatus, or more in particular to an improvement of a high speed printing apparatus in which printing is effected in such a manner that ink particles adhere to ions generated by the application of a high voltage and the ink particles are absorbed selectively to printing paper for printing.

A high speed printing apparatus has been developed in which ions generated between electrodes impressed with a high voltage are caused to fly in an ink mist and to be absorbed onto the recording paper. In this printing apparatus, however, due to the presence of an ink mist diffused forwardly of the recording paper, the recording paper is smeared by the ink mist when the printing operation is stopped and feed of the recording paper is stopped. Another problem is the fact that an ink solvent is thermally evaporated and then adhered on the electrodes and recording paper, the deposited ink solvent being liquefied with the result of a smearing of the recording paper.

To solve the above-mentioned problems, a shutter plate or thin metal belt is interposed between a recording paper and an ink mist for the purpose of protecting the recording paper from the ink mist. In spite of this measure, the adherence of the ink mist to the shutter plate or to the metal belt cannot be prevented.

The present invention has been made in view of this situation and provides a high speed printer in which an air barrier is formed between an ink mist and a recording paper for selectively circulating the air flow to keep the ink mist away from the recording paper.

FIG. 1 is a schematic diagram of the printing section of the high speed printing apparatus according to the present invention.

An embodiment of the invention will be detailed below with reference to the drawing. Reference numeral 1 designates a recording paper, numeral 2 a positive (+) electrode of tungsten, numeral 3 a negative (−) electrode arranged opposite to the positive electrode, numeral 4 an aperture board for selectively controlling an ion flow generated from the positive electrode 2, numeral 5 a mist tank changing ink 6 to a mist state, numeral 7 an oscillator comprising a piezoelectric element, numeral 8 an air path for delivering an air flow for causing the diffusion of the ink mist, numeral 9 an air path for forming an air shutter forwardly of the recording paper, numeral 10 an electromagnetic valve operative in response to a "print" command, numeral 11 a pump for delivering air, numeral 12 a condenser for condensing and liquefying the ink mist, numeral 13 an ink tank for collecting the ink liquefied by the condenser, and numeral 14 an air lip for introducing the ink mist to the condenser 12.

The printing operation of the high speed printing apparatus with the above-mentioned construction will be explained. Oscillation of the oscillator 7 causes the ink to be atomized, i.e. changed to a mist state, and the atomized ink departing from the mist tank 5 is diffused between the recording paper 1 and the aperture board 4 by means of the air flow in the air path 8. A high voltage is applied between the positive electrode 2 and the negative electrode 3 thereby to generate an ion flow from the positive electrode 2 to the negative electrode 3. This ion flow is selectively controlled by the aperture board 4 and bombarded to a streamline flow of the ink particles, so that the ink particles are charged and accelerated toward the negative electrode 3 for the adherence to the recording paper 1, thereby to print characters thereon in a dot form. The electromagnetic valve 10 is closed simultaneously with the "print" command and therefore no air shutter is formed during the printing operation.

Upon completion of the printing operation, the electromagnetic valve 10 is opened again and delivers out an air flow thereby to form an air shutter forwardly of the recording paper 1. Under this condition, the ink mist is delivered to the air lip 14 without adhering to the recording paper 1 and is separated into ink and air by the condenser 12, the air being recirculated by the pump 11.

As mentioned above, the high speed printing apparatus according to the present invention is such that a layer of air flow is formed selectively forwardly of the recording paper 1 in response to the start and completion of the printing operation, thereby preventing the ink mist from adhering to the recording paper 1.

It will be understood from the above explanation that according to the present invention the recording paper is effectively prevented from being smeared when the printer is not operated or when the recording paper is not fed.

What is claimed is:

1. In a method of printing on a recording medium utilizing a mist of liquid ink particles which are charged by ions and accelerated toward and onto the recording medium by an electrical field, the improvement comprising the step of:

selectively forming a layer of the air forwardly of, and parallel and adjacent to, the recording medium in response to the completion of the printing operation to prevent the ink mist from adhering to the recording medium while printing is not occurring.

2. The improvement of claim 1 wherein the step of selectively forming a layer of air is carried out by means of a valve which is normally open to permit formation of the air layer, but which is closed simultaneously with commencement of the printing operation and is maintained closed throughout the printing operation, opening again upon completion of the printing operation.

3. In a printing system utilizing a mist of liquid ink particles emanating from a source which are charged by ions and accelerated toward and onto the recording medium by an electrical field, the improvement comprising:

means for imposing a layer of air in a region between the source of ink mist and the recording medium, said layer being parallel and adjacent to the recording medium, said means selectively controllable to deliver the air layer to said region when the printing system is not in operation and to cease delivery of the air layer when the printing system is in operation.

4. The improvement of claim 3 wherein said selectively controllable means comprises a valve which is opened when the printing system is not in operation and is closed when the printing system is in operation.

5. The improvement of claim 4 wherein said valve is an electromagnetic valve which opens simultaneously with actuation of the printing operation and closes simultaneously with cessation of the printing operation.

* * * * *